US009961441B2

(12) United States Patent
Chen

(10) Patent No.: US 9,961,441 B2
(45) Date of Patent: May 1, 2018

(54) NEAR-END LISTENING INTELLIGIBILITY ENHANCEMENT

(71) Applicant: DSP Group LTD., Herzeliya (IL)

(72) Inventor: Yaakov Chen, Rishon Le-tzion (IL)

(73) Assignee: DSP Group Ltd., Herzliya (IL)

( * ) Notice: Subject to any disclaimer, the term of this patent is extended or adjusted under 35 U.S.C. 154(b) by 142 days.

(21) Appl. No.: 14/314,064

(22) Filed: Jun. 25, 2014

(65) Prior Publication Data

US 2015/0003628 A1 Jan. 1, 2015

Related U.S. Application Data

(60) Provisional application No. 61/839,898, filed on Jun. 27, 2013.

(51) Int. Cl.

| | |
|---|---|
| ***H04R 3/00*** | (2006.01) |
| ***G10L 21/043*** | (2013.01) |
| ***G10L 21/0316*** | (2013.01) |
| ***G10L 21/0208*** | (2013.01) |

(52) U.S. Cl.

CPC ..... *H04R 3/002* (2013.01); *G10L 21/0208* (2013.01); *G10L 21/0316* (2013.01); *G10L 21/043* (2013.01); *H04R 2410/05* (2013.01); *H04R 2499/11* (2013.01)

(58) Field of Classification Search

USPC ..... 381/58, 71.14, 96; 379/390.1; 700/94; 345/174; 704/233, 205, 500, 207, 226

See application file for complete search history.

(56) References Cited

U.S. PATENT DOCUMENTS

| | | | | |
|---|---|---|---|---|
| 4,461,024 | A * | 7/1984 | Rengger | G10L 15/20 704/233 |
| 4,864,620 | A * | 9/1989 | Bialick | G10L 21/04 704/207 |
| 5,251,263 | A | 10/1993 | Andrea et al. | |
| 6,445,799 | B1 | 9/2002 | Taenzer et al. | |
| 2004/0252109 | A1 * | 12/2004 | Trent, Jr. | G06F 3/03547 345/174 |
| 2007/0133821 | A1 * | 6/2007 | Yamaguchi | H03G 3/3005 381/96 |
| 2007/0150263 | A1 * | 6/2007 | Zhang | G10L 15/20 704/205 |
| 2009/0248409 | A1 * | 10/2009 | Endo | H03G 3/32 704/226 |
| 2011/0029317 | A1 * | 2/2011 | Chen | G10L 19/22 704/500 |

(Continued)

*Primary Examiner* — Md S Elahee

(74) *Attorney, Agent, or Firm* — Reches Patents

(57) ABSTRACT

Methods and systems are provided for enhancing listening intelligibility in electronic devices. A vibration sensor may be used to generate feedback corresponding to vibrations caused by the outputting of the acoustic signals, and the feedback may be used in adjusting the listening intelligibility stage. In some instances, a microphone may be used to obtain audio input corresponding to ambient noise affecting intelligibility of audio outputted, as acoustic signals, via a speaker, to a user. The audio input may be used to control a listening intelligibility stage applied to audio content when the acoustic signals are generated for outputting by the speaker. In particular, the listening intelligibility stage may comprise application of dynamic time-scale modifications.

31 Claims, 6 Drawing Sheets

(56) References Cited

U.S. PATENT DOCUMENTS

| | | | | |
|---|---|---|---|---|
| 2012/0071997 | A1* | 3/2012 | Aliakseyeu ..... | G08G 1/0965 700/94 |
| 2012/0158403 | A1 | 6/2012 | Togawa et al. | |
| 2013/0259221 | A1* | 10/2013 | Shusaku ..... | H04M 1/6016 379/390.01 |

* cited by examiner

NEAR-END LISTENING INTELLIGIBILITY ENHANCEMENT

CLAIM OF PRIORITY

This patent application makes reference to, claims priority to and claims benefit from the U.S. Provisional Patent Application No. 61/839,898, filed on Jun. 27, 2013, which is hereby incorporated herein by reference in its entirety.

TECHNICAL FIELD

Aspects of the present application relate to audio processing. More specifically, certain implementations of the present disclosure relate to methods and systems for improvements in near-end listening intelligibility enhancement.

BACKGROUND

Existing methods and systems for providing audio processing, particularly for enhancing listening intelligibility, may be inefficient and/or costly. Further limitations and disadvantages of conventional and traditional approaches will become apparent to one of skill in the art, through comparison of such approaches with some aspects of the present method and apparatus set forth in the remainder of this disclosure with reference to the drawings.

BRIEF SUMMARY

A system and/or method is provided for improvements in near-end listening intelligibility enhancement, substantially as shown in and/or described in connection with at least one of the figures, as set forth more completely in the claims.

These and other advantages, aspects and novel features of the present disclosure, as well as details of illustrated implementation(s) thereof, will be more fully understood from the following description and drawings.

DETAILED DESCRIPTION

Certain example implementations may be found in method and system for non-intrusive noise cancellation in electronic devices, particularly in user-supported devices. As utilized herein the terms "circuits" and "circuitry" refer to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first plurality of lines of code and may comprise a second "circuit" when executing a second plurality of lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the terms "block" and "module" refer to functions than can be performed by one or more circuits. As utilized herein, the term "example" means serving as a non-limiting example, instance, or illustration. As utilized herein, the terms "for example" and "e.g.," introduce a list of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled, or not enabled, by some user-configurable setting.

Figure 1:
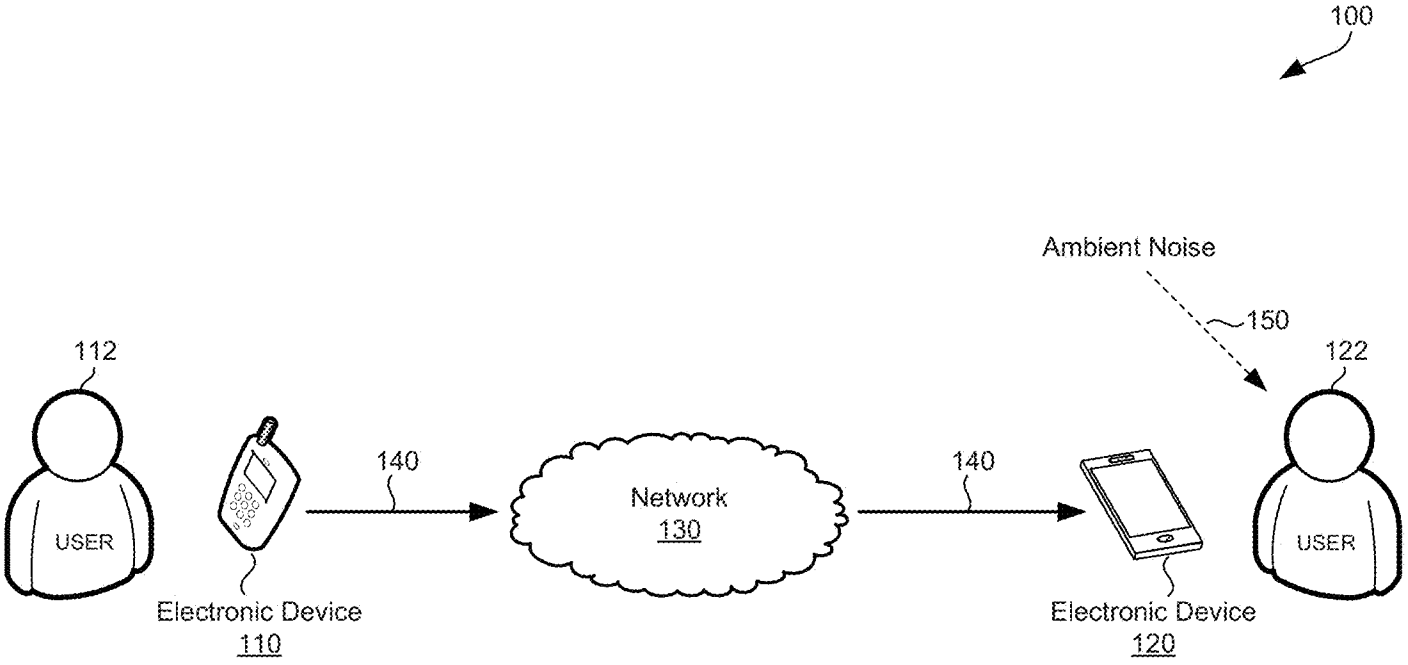
FIG. 1 illustrates an example communication system that may be used for communicating audio.

FIG. 1 illustrates an example communication system that may be used for communicating audio. Referring to FIG. 1, there is shown a communication system 100 comprising electronic devices 110 and 120, a network 130.

The communication system 100 may comprise a plurality of devices (of which the electronic devices 110 and 120 are shown), and communication resources (of which the network 130 is shown) to enable the devices to communicate with one another, such as via the network 130. The communication system 100 is not limited to any particular type of communication media, interfaces, or technologies.

Each of the electronic devices 110 and 120 may comprise suitable circuitry for implementing various aspects of the present disclosure. The electronic devices 110 and/or 120 may be, for example, configurable for performing or supporting various functions, operations, applications, and/or services. The functions, operations, applications, and/or services performed or supported by the electronic devices may be run or controlled based on user instructions and/or pre-configured instructions.

In some instances, electronic devices, such as the electronic devices 110 and/or 120, may support communication of data, such as via wired and/or wireless connections, in accordance with one or more supported wireless and/or wired protocols or standards.

Further, in some instances electronic devices, such as the electronic devices 110 and/or 120, may be a mobile and/or handheld device—i.e. intended to be held or otherwise supported by a user during use of the device, thus allowing for use of the device on the move and/or at different locations. In this regard, an electronic device may be designed and/or configured to allow for ease of movement, such as to allow it to be readily moved while being held by the user as the user moves, and the electronic device may be configured to perform at least some of the operations, functions, applications and/or services supported by the device while the user is on the move.

In some instances, electronic devices may support input and/or output of audio. For example, each of the electronic devices 110 and 120 may incorporate, for example, a plurality of speakers and microphones, for use in outputting and/or inputting (capturing) audio, along with suitable circuitry for driving, controlling and/or utilizing the speakers and microphones.

Examples of electronic devices may comprise communication devices (e.g., corded or cordless phones, mobile phones including smartphones, VoIP phones, satellite phones, etc.), handheld personal devices (e.g., tablets or the like), computers (e.g., desktops, laptops, and servers), dedicated media devices (e.g., televisions, audio or media players, cameras, conferencing systems equipment, etc.), and the like. In some instances, electronic device may be wearable devices—i.e. may be worn by the device's user rather than being held in the user's hands. Examples of wearable electronic devices may comprise digital watches and watch-like devices (e.g., iWatch), glasses-like devices (e.g., Google Glass), or any suitable wearable listening and/or communication devices (e.g., Bluetooth earpieces). The disclosure, however, is not limited to any particular type of electronic device.

The network 130 may comprise a system of interconnected nodes and/or resources (hardware and/or software), for facilitating exchange and/or forwarding (including, e.g., such functions as routing, switching, and the like) of data among a plurality of devices, and thus a plurality of end users, based on one or more networking standards. Physical connectivity within, and/or to or from the network 130, may be provided using, for example, copper wires, fiber-optic cables, wireless links, and the like. The network 130 may correspond to any suitable landline based phone network, cellular network, satellite network, the Internet, local area network (LAN), wide area network (WAN), or any combination thereof.

In operation, the electronic devices 110 and 120 may communicate with one another within the communication system 100, such as via the network 130. The communication between the electronic devices 110 and 120 may comprise exchange of data, which may include audio content (e.g., voice and/or other audio). For example, the electronic devices 110 and 120 may be communication devices (e.g., landline or mobile phones, or the like), which may be used to conduct voice calls between devices users (e.g., users 112 and 122). In the example communication scenario shown in FIG. 1, audio content may be communicated from the electronic device 110 to the electronic device 120—thus the electronic device 110 may be the transmit-side device (also referred to as 'far-end') and the electronic device 120 may be the receive-side device (also referred to as 'near-end'). Nonetheless, a device may be both a transmit-side device and a receive-side device, such as during bidirectional exchange of audio content (e.g., where the electronic devices 110 and 120 are being utilized to conduct a voice call between users 112 and 122).

The exchange of audio content may entail converting the audio content to signals suited for communication, such as over the network 130. For example, the electronic device 110—that is the transmit-side device that is transmitting data containing audio content—may incorporate one or more suitable transducers, and related audio processing circuitry, for use in transferring acoustic signals into electric signals (e.g., data). Examples of common transducers used in this manner may comprise a microphone which may be used in receiving (e.g., capturing) acoustic signals, which may be processed to output corresponding analog or digital signals, which may then be communicated through the network 130, such as over connection 140 (e.g., comprising one or more suitable wired and/or wireless connections, into and/or through the network 130), to the electronic device 120.

The electronic device 120—that is the receive-side device that is receiving data containing audio content—may incorporate one or more suitable transducers (and related audio processing circuitry), for use in transferring the received electric signals (e.g., data) into acoustic signals. Examples for common transducers used in this manner may comprise speakers, earpieces, headsets, and the like. Thus, the electronic device 120 may process signals received over connection 140, extract receive audio (i.e., audio transmitted from the far-end) carried therein, and generate acoustic signals based thereon that can be outputted to the user 122.

The quality of audio (e.g., voice and/or other audio) outputted by electronic devices may be affected by and/or may depend on various factors. For example, the quality of the voice and/or other audio may depend on the resources being used (transducer circuitry, transmitter circuitry, receiver circuitry, network, etc.) and/or environmental conditions. The quality of audio (and/or listening intelligibility experience associated with the audio) may be affected by a noise environment. In this regard, a noisy environment may be caused by various conditions, such as wind, ambient audio (e.g., other users talking in the vicinity, music, traffic, etc.), or the like. All these conditions combined may be described hereinafter as ambient noise (an example of which is shown in FIG. 1, as the reference 150, at the receive-side—i.e. with respect to the electronic device 120).

Ambient noise may affect quality of audio at both ends (i.e. both at transfer-side or far-end, and at receive-end or near-end). In this regard, ambient noise at the far-end may be combined (unintentionally) with the intended audio that is captured by the far-end device. Thus, the signals communicated from the far-end may incorporate both desired content and non-desired content (corresponding to the ambient noise at the far-end). At the near-end, ambient noise may affect quality of audio (particularly listening intelligibility).

For example, during communication of audio content, the listener at the near-end (e.g., user 122 listening intelligibility to audio output from the electronic device 120) may not only hear the far-end audio, as produced from audio output components (e.g., speaker(s) of the electronic device 120), but may also hear or be subject to the local ambient noise (e.g., ambient noise 150) that is present in the location of the listener (e.g., in the vicinity of user 122). In instances of high ambient noise the near-end listening intelligibility experience may be deteriorated and may cause the received voice intelligibility to be significantly reduced even to the point of unintelligibility. Because the ambient noise would likely reach the ears of the near-end listener, it may be hard to be influenced (by the device). Thus, enhancing the output audio (e.g., received far-end audio) may require compensating for the noise.

According, in various implementations of the present disclosure, audio operations in devices may be configured to incorporate listening intelligibility enhancement measures, which may be particularly configured or modified to mitigate or reduce effects of ambient noise while a user is listening to audio. For example, in audio communication setups (e.g., as the one shown in FIG. 1), the near-end device (e.g., by the electronic device 120) may incorporate measures and/or components for enhancing listening intelligibility, such as by processing the far-end audio signals (e.g., audio in signals received from the electronic device 110) in a manner that may enable compensating for the local near-end ambient noise (e.g., ambient noise 150).

For example, the electronic devices may incorporate dedicated components (and/or may incorporate modification to existing components) for providing the desired listening intelligibility enhancement. These components may be referred to, collectively, as listening intelligibility enhancement system (or 'LES'). The LES may be configurable to apply a listening enhancement stage, when far-end audio signal (e.g., audio, particular speech, received via connection 140) is outputted via audio output components (e.g., speakers) in the device. In this regard, the listening enhancement stage may be superimposed between the received (to be outputted) signal and the speakers. The listening enhancement stage may be configured based on local ambient noise (e.g., ambient noise 150). In this regard, the LES may be configured to obtain near-end inputs that may enable measuring or estimating (very accurately) the ambient noise, or effects thereof on the listening experience of the user. Thus, the LSE may be configured to adaptively attempt to enhance the received signal such that corresponding output signal (e.g., speaker signal) is particularly configured to compensate for or cancel effects of ambient noise.

In this regard, various techniques may be used to enhance speech in the presence of noise, but they generally fall into the category of raising the speech spectrum over the noise spectrum in an attempt to improve the signal to noise ratio ("SNR") of the speech signal. With listening intelligibility, the objective is to improve the speech intelligibility based upon analysis of the speech and noise, in order to produce an enhanced speech output. However, typical techniques do not use feedback information, such as to enable determining whether the resulting enhanced speech is acceptable, or indeed, still intelligible. As these techniques generally rely on boosting certain spectral parts of the speech signal in order to overcome the noise, there is no feedback to indicate unsatisfactory performance—e.g., when the speaker may be in a limiting state, thus further distorting the output signal presented to the listener. Further, not all feedback may be sufficient to optimize performance. For example, in some instance, there may be some feedback of the output signals sent to the speakers; but there typically is no feedback of the actual acoustic signals outputted by speaker, which may include distortions—e.g., due to enclosure vibrations and/or digital to analog conversions. Thus, there is no knowledge of whether the resulting spectral components of the 'enhanced' output will be selectively distorted by the speaker or whether the acoustic quality of the signal that is presented to the listener will include other distortion effects including those due to enclosure vibrations and digital to analog conversion.

Accordingly, in certain LES implementations in accordance with the present disclosure, the LES may use a feedback signal which may be derived from the actual acoustic output of the speaker, and by so doing the feedback signal provides information to the LES that can be used to optimize the speech intelligibility. Further, in certain LES implementations in accordance with the present disclosure, the speech intelligibility may be optimally enhanced based on adjustments applied to the output signals. For example, in some instances, the dynamic time-scale modifications may be applied to the output signals. With time-scale modifications, speed or duration of an audio signal may be adaptively changed, without affecting its pitch. Slowing down or stretching speech, using time-scale modification may increase speech intelligibility. Thus in some LES implementations in accordance with the present disclosure, which may be based on dynamic time-scale modifications, control of output (e.g., speaker) signals may incorporate or use a dynamic varying of the degree of the slow-down of the speech in proportion to the detected noise. In this regard, the percentage of the speech stretching may be updated dynamically as a function of extracted noise parameters. Nonetheless, slowing down or stretching a speech signal in real time may normally result in an accumulating delay. The delay may be compensated for, however, such as by detecting non-speech parts in the speech signals (e.g., corresponding to pauses in the conversation), and then shortening these parts in the output signals so as to reduce the delay.

While listening intelligibility enhancement is described in some of the example implementations in the context of far-end audio—i.e. audio received from remote sources, such as during call with another device, the disclosure is not so limited. Rather, the same mechanisms may be used to enhance listening intelligibility experience with respect to near-end audio—i.e. local audio, such as audio generated or played in the same device.

Figure 2:
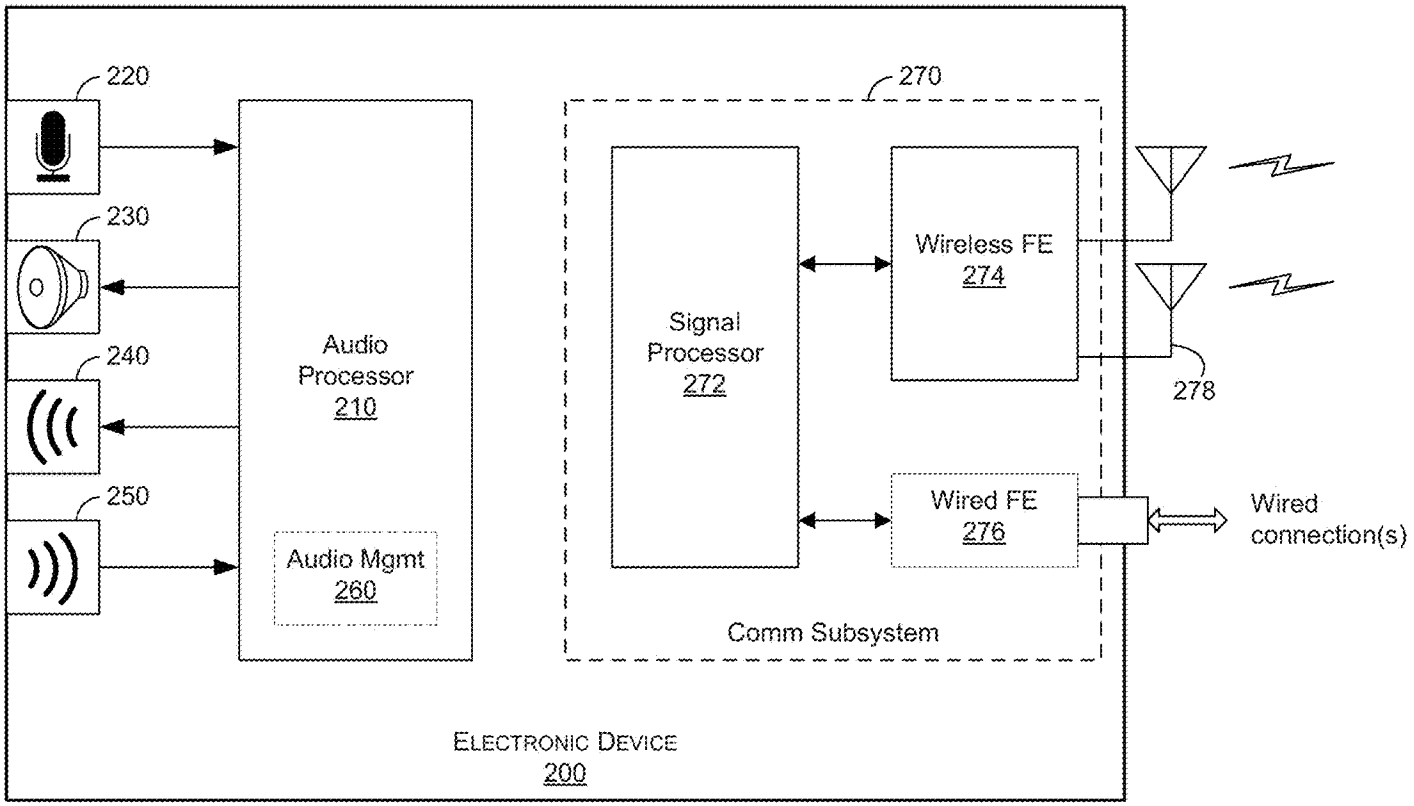
FIG. 2 illustrates an example electronic device that may support near-end listening intelligibility enhancement.

FIG. 2 illustrates an example electronic device that may support near-end listening intelligibility enhancement. Referring to FIG. 2, there is shown an electronic system 200.

The electronic system 200 may comprise suitable circuitry for implementing various aspects of the disclosure. The electronic system 200 may correspond to one or both of the electronic devices 110 and 120 of FIG. 1. The electronic system 200 may comprise, for example, an audio processor 210, an audio input device (e.g., a microphone) 220, an audio output device (e.g., a speaker) 230, a bone conduction element (e.g., speaker) 240, a vibration sensor (e.g., VSensor) 250, an audio management block 260, and a communication subsystem 270.

The audio processor 210 may comprise suitable circuitry for performing various audio signal processing functions in the electronic system 200. The audio processor 210 may be operable, for example, to process audio signals captured via input audio components (e.g., the microphone 220), to enable converting them to electrical signals—e.g., for storage and/or communication external to the electronic system 200. The audio processor 210 may also be operable to process electrical signals to generate corresponding audio signals for output via output audio components (e.g., the speaker 230). The audio processor 210 may also comprise suitable circuitry configurable to perform additional, audio related functions—e.g., voice coding/decoding operations. In this regard, the audio processor 210 may comprise analog-to-digital converters (ADCs), one or more digital-to-analog converters (DACs), and/or one or more multiplexers (MUXs), which may be used in directing signals handled in the audio processor 210 to appropriate input and output ports thereof. The audio processor 210 may comprise a general purpose processor, which may be configured to perform or support particular types of operations (e.g., audio related operations). Alternatively, the audio processor 210 may comprise a special purpose processor—e.g., a digital signal processor (DSP), a baseband processor, and/or an application processor (e.g., ASIC).

The audio management block 260 may comprise suitable circuitry for managing audio related functions in the electronic system 200. For example, the audio management block 260 may manage audio enhancement related functions, such as noise reduction, noise suppression, echo cancellation, distortion reduction, and the like, which may be performed by the audio processor 210. The audio management block 260 may also support additional audio quality related operations, such as analysis of audio (e.g., to determine or estimate audio quality measurements). In some instances, the audio management block 260 may support audio quality feedback related operations. As shown in FIG. 2, the audio management block 260 may be part of the audio processor 210. In some instances, however, the audio management block 260 may be implemented as a dedicated, stand-alone component (e.g., dedicated processing circuitry).

The communication subsystem 270 may comprise suitable circuitry for supporting communication of data to and/or from the electronic system 200. For example, the communication subsystem 270 may comprise a signal processor 272, a wireless front-end 274, a wired front-end 276, and one or more antennas 278. The signal processor 272 may comprise suitable circuitry for processing signals transmitted and/or received by the electronic system 200, in accordance with one or more wired or wireless protocols supported by the electronic system 200. The signal processor 272 may be operable to perform such signal processing operation(s) as filtering, amplification, up-conversion/down-conversion of baseband signals, analog-to-digital conversion and/or digital-to-analog conversion, encoding/decoding, encryption/decryption, and/or modulation/demodulation. The wireless FE 274 may comprise suitable circuitry for performing wireless transmission and/or reception (e.g., via the antenna(s) 278), such as over a plurality of supported RF bands. The antenna(s) 278 may comprise suitable circuitry for facilitating over-the-air transmission and/or reception of wireless signals within certain bandwidths and/or in accordance with one or more wireless interfaces supported by the electronic system 200. The wired FE 276 may comprise suitable circuitry for performing wired based transmission and/or reception, such as over a plurality of supported physical wired media. The wired FE 276 may support communications of RF signals via the plurality of wired connectors, within certain bandwidths and/or in accordance with one or more wired protocols (e.g., Ethernet) supported by the electronic system 200.

In operation, the electronic system 200 may be utilized in supporting communication of audio (e.g., voice and/or other audio). Further, the electronic device may support use of noise related functions in conjunction with the communication of audio, with support for receive-side and/or network based noise control feedback. For example, the communication subsystem 270 may be utilized in setting up and/or utilizing connections that may be used in communication of audio content (e.g., the connections 140), and/or connections for use in communication of noise control feedback (e.g., the audio feedback 150). These connections may be established using wired and/or wireless links (via the wired FE 276 and/or the wireless FE 274, respectively).

The audio related components of the electronic system 200 may be used in conjunction with handling of communicated audio content. For example, when the electronic system 200 is functioning as a transmit-side device, audio signals may be captured via the microphone 220, processed in the audio processor 210—e.g., converting them into digital data, which may then be processed via the signal processor 272, then transmitted via the wired FE 276 and/or the wireless FE 274. When the electronic system 200 is functioning as receive-side device, signals carrying audio content may be received via the wired FE 276 and/or the wireless FE 274, then processed via the signal processor 272, to extract the data corresponding to the audio content, which (the data) may then be processed via the audio processor 210 to convert them to audio signals that may be outputted via the speaker 230.

In some instances, it may be necessary to perform particular audio quality enhancement related functions in the electronic device 200. For example, ambient noise may sometimes affect listening experience of a device user trying to listen to audio outputted via the speaker 230. In this regard, the output of the speaker 230 may comprise acoustic signals corresponding to audio content handled in the electronic device 200. The audio content may be content received from another device (i.e. far-end audio, such as audio received from a remote peer in a two-way voice call). Alternatively, the audio content may be local—e.g., music or other audio that is generated or stored with or in the electronic device 200. Accordingly, the electronic device 200 may incorporate various measures for enhancing listening (e.g., speech) intelligibility of audio received by the device user, including, for example, in noisy conditions (i.e., in the presence of the ambient noise). For example, the electronic device 200 may incorporate various listening intelligibility enhancement implementations, such as described with respect to FIG. 1 for example. In this regard, the listening intelligibility enhancement may be provided or performed by various components of the electronic device 200 which may be used in conjunction with audio operations—e.g., the audio processer 210, audio related input/output components (microphone 220, speaker 230, bone conduction element 240, vibration sensor 250), and/or the audio management block 260. The listening intelligibility enhancement may be controlled based on detection of the condition causing degradation of the listening intelligibility. For example, ambient noise, which may sometimes degrade listening intelligibility, may be detected using the microphone 220. The resulting microphone signal may then be processed to obtain noise related parameters, which may be used in controlling listening intelligibility enhancement in the electronic device 200.

In some instances, listening intelligibility enhancement may be based on feedback. For example, a feedback signal may be derived from actual acoustic output of the speaker 230. The feedback signal may be obtained via the vibration sensor 250, and may correspond to vibrations created in the case of the electronic device 200 due to the outputting of acoustic signals by the speaker 230. The feedback signal may be used to provide information that may enable determining (or controlling) the listening intelligibility enhancement that should be applied to optimize the speech intelligibility (and thus the listener experience).

In some instances, listening intelligibility enhancement may be achieved by determining and applying certain adjustments applied to the output signals (i.e., the acoustic signals generated for the speaker 230 based on the audio content), such as using dynamic time-scale modifications. In this regard, the electronic device 200 (e.g., via the audio management block 270) may determine, dynamically, time-scale modifications—that is adaptive adjustments to the speed or duration of the audio, without affecting its pitch. For example, the acoustic output (e.g., of the speaker 230) may be generated in a manner that may allow dynamic varying of the degree of the slow-down of the speech, such as in proportion to the detected ambient noise. Thus, the degree of time-scale modification—e.g., percentage of the speech stretching—may be updated dynamically as a function of extracted noise parameters. Further, because slowing down or stretching a speech signal in real time may normally result in an accumulating delay, the electronic device 200 may be configured to compensate for such delays, such as by detecting non-speech parts in the audio signals (e.g., corresponding to pauses in the conversation), and then shortening these parts in the output signals so as to mitigate or reduce the delay. Examples of particular feedback based and dynamically time-scale modification based listening intelligibility enhancement implementations are described in more detail with respect to the following figures.

Figure 3:
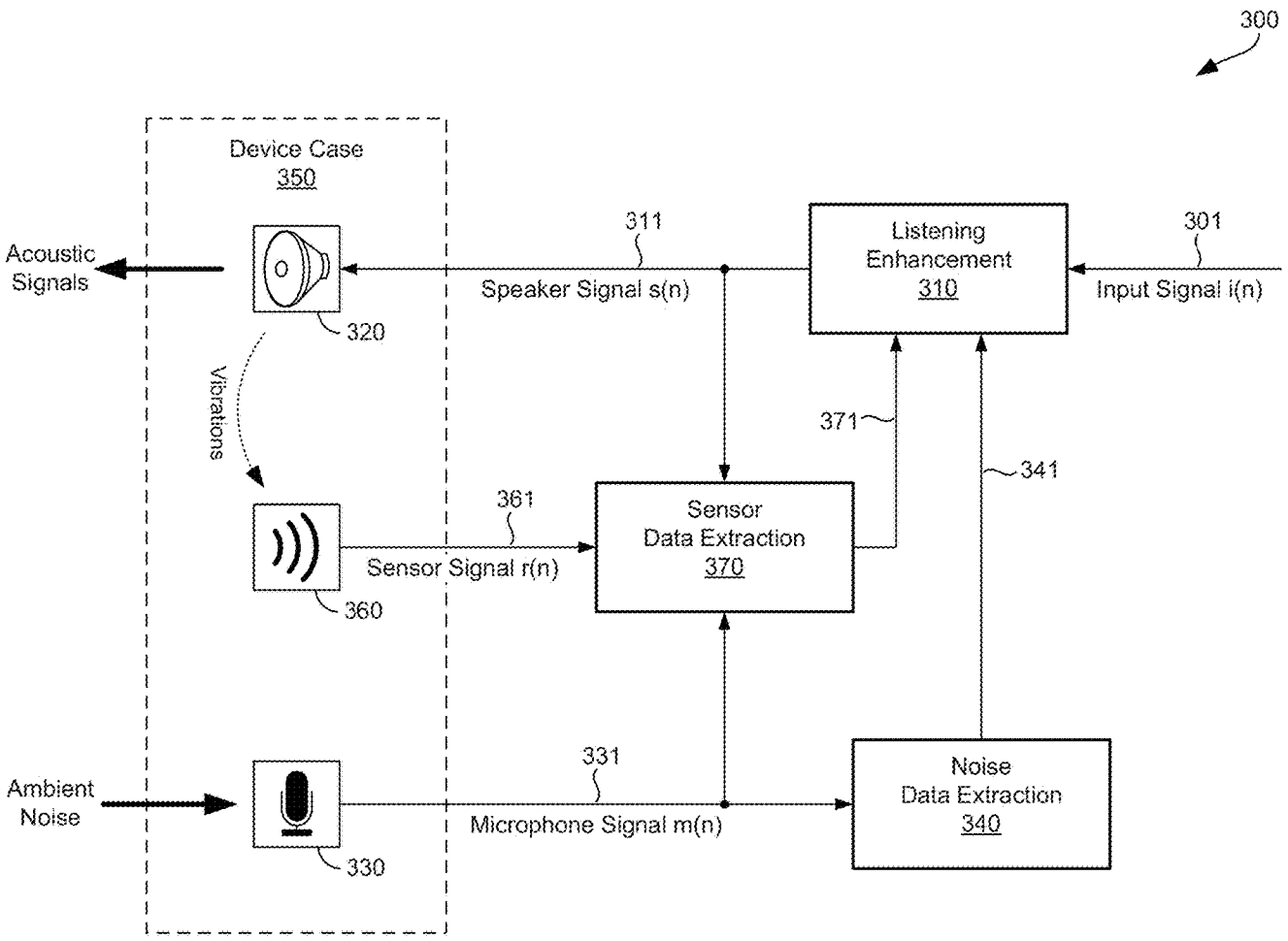
FIG. 3 illustrates an example system that may support near-end listening intelligibility enhancement based on acoustic feedback.

FIG. 3 illustrates an example system that may support near-end listening intelligibility enhancement based on acoustic feedback. Referring to FIG. 3, there is shown a system 300 for providing listening intelligibility enhancement based on acoustic feedback.

The system 300 may comprise suitable circuitry for outputting audio, and for providing adaptive enhancement of intelligibility associated therewith, particularly based on acoustic feedback. The feedback may be obtained based on sensory of vibration in the case of a device incorporating the system 300. Thus the system 300 may correspond to the electronic device 200 (or portions thereof) when that device is utilized during outputting of acoustics signals comprising speech or other audio that may be experienced by listeners. As shown in the example implementation depicted in FIG. 3, the system 300 may comprise a listening enhancement block 310, a speaker 320, a microphone 330, a noise data extraction block 340, a sensor (e.g., vibration sensor or VSensor) 360, and a sensor data extraction block 370.

The listening enhancement block 310 may comprise suitable circuitry for generating output acoustic signals, for outputting via a speaker (e.g., the speaker 320), based on input signals, and to particularly configure the generated output acoustic signals that optimize listening intelligibility by listeners. In this regard, the listening enhancement block 310 may be configured to utilize various methods for improve the intelligibility of speech signals outputted by system 300. For example, the listening enhancement block 310 may be configured to enhance the listening intelligibility by increasing effective signal to noise ratio of the speech signals. This can be done by analyzing the spectral make-up of the speech and noise signals, and then using some form of dynamic spectral subtraction or selective spectrum boosting.

The noise data extraction block 340 may comprise suitable circuitry for processing signals corresponding to noise, such as to provide data that may be used for adaptive noise based control of audio output operations in the system 300. The noise data extraction block 340 may be configured to analyze, for example, captured microphone signals, corresponding to ambient noise, to enable obtaining or generating ambient noise related parameters.

The sensor data extraction block 370 may comprise suitable circuitry for processing signals corresponding to particular sensory input (e.g., vibration), such as to provide data that may be used for adaptive control of audio output operations in the system 300. The sensor data extraction block 370 may be configured to analyze, for example, captured vibrations, corresponding to acoustic output of the system 300 (via the speaker 320), to enable obtaining or generating sensor signal related parameters. For example, the sensor data extraction block 370 may be operable to process signals corresponding to captured ambient noise, with the processing comprising, for example, extracting amplitude of the noise (signals), or the whole spectrum of the noise that may affect the output operations (e.g., mask the speech coming from the far-side). Further, the processing may comprise determining such information relating to the processed signals (noise) as the type of the noise, using such techniques as auditory scene analysis (ASA) for example.

In operation, the system 300 may be utilized to output audio, represented as input signal 301, i(n), and to particularly provide enhanced listening intelligibility, based on acoustic feedback. The input signal 301, i(n), may correspond to far-end audio (i.e. audio originating from a remote source, which is communicating the audio to a device incorporating the system 300), or may be a near-end audio or speech—i.e. generated in the same device that incorporates the system 300. The listening intelligibility may be affected by ambient noise. Accordingly, to support the listening intelligibility enhancement, ambient noise may be detected by the microphone 330, with the corresponding microphone output 331, m(n), being applied to the noise data extraction block 340. The noise data extraction block 340 may be configured to detect the ambient noise data (e.g., signal parameters), and pass the data to the listening enhancement block 310. The input signal 301, i(n), may also be applied to the listening enhancement block 310, which may generate a corresponding output (e.g., a speaker signal 311, s(n)) that may configured based on the input signal 301, i(n), such that it may be applied to the speaker 320, to cause the speaker 320 to produces the acoustic output signals that the listener would experience. In order to provide feedback of the resulting acoustic signal to the listening enhancement block 310, the sensor 360 may be used to detect vibrations in the device casing (enclosure or housing) 350, and generate a corresponding sensor output 361, r(n).

The sensor output 361 may correspond to the signals due to the speaker 320. Thus, the sensor output 361 may essentially include acoustics corresponding to speaker signal 311, s(n), but may also include other signals or components (e.g., all the nonlinearities of the speech signal due to the speaker, such as the enclosure vibrations and the digital to analog conversion of the received signal, the frequency response of the speaker, etc.). Further, the sensor output 361 would not include signals, or will only include a negligible amount of the signals that are part of the microphone output 331 (e.g., ambient noise, speech of the user—that is the near-end user (122) when talking, etc.) in comparison with the speaker acoustic output signal. The sensor output 361, therefore, may represent very accurate reproduction of the acoustic signal that is experienced by the listener.

The sensor output 361 may be applied to the sensor data extraction block 370, which may extract data (e.g., signal parameters) relating to the real-time intelligibility and distortion, if present, in the sensor output 361, which correspond to the speaker acoustic output. For example, the sensor data extraction block 370 may calculate the frequency content of r(n), to enable comparing sensor output 361 to signals in the output path (e.g., the input signal 301, i(n), and the speaker signal 311, s(n)) to identify or determine optimum intelligibly parameters.

The sensor signal data may then be fed to the listening enhancement block 310, and may be used thereby as a feedback of the output (i.e., speaker signal 311) of the listening enhancement block 310. The sensor data extraction block 370 can also take into account, in addition to the sensor signal 361, the microphone signal 331 and the speaker signal 311 in order to provide more accurate parameters to the listening enhancement block 310.

The parameters that can be extracted by the sensor data extraction block 370 may include an indication of the speech intelligibility, the distortion level and associated frequencies, and a metric of the difference between the speaker signal 311 and the sensor signal 361. The listening enhancement block 310 may, using such information and/or parameters, optimize its processing in order to produce optimal speech intelligibility. With this feedback of the speaker acoustic parameters, the listening enhancement block 310 may have direct knowledge of its actions and will be able to reduce the distortion and improve the intelligibility of the signal presented to the listener. For example, based on the extracted information and/or parameters, it may be possible to detect distortion in some specific frequencies, which may allow for keeping particular content of i(n) intact by amplifying other frequencies. Also, a maximum gain parameter may be generated from the feedback, being particularly set or adjusted to block distortion states.

Figure 4:
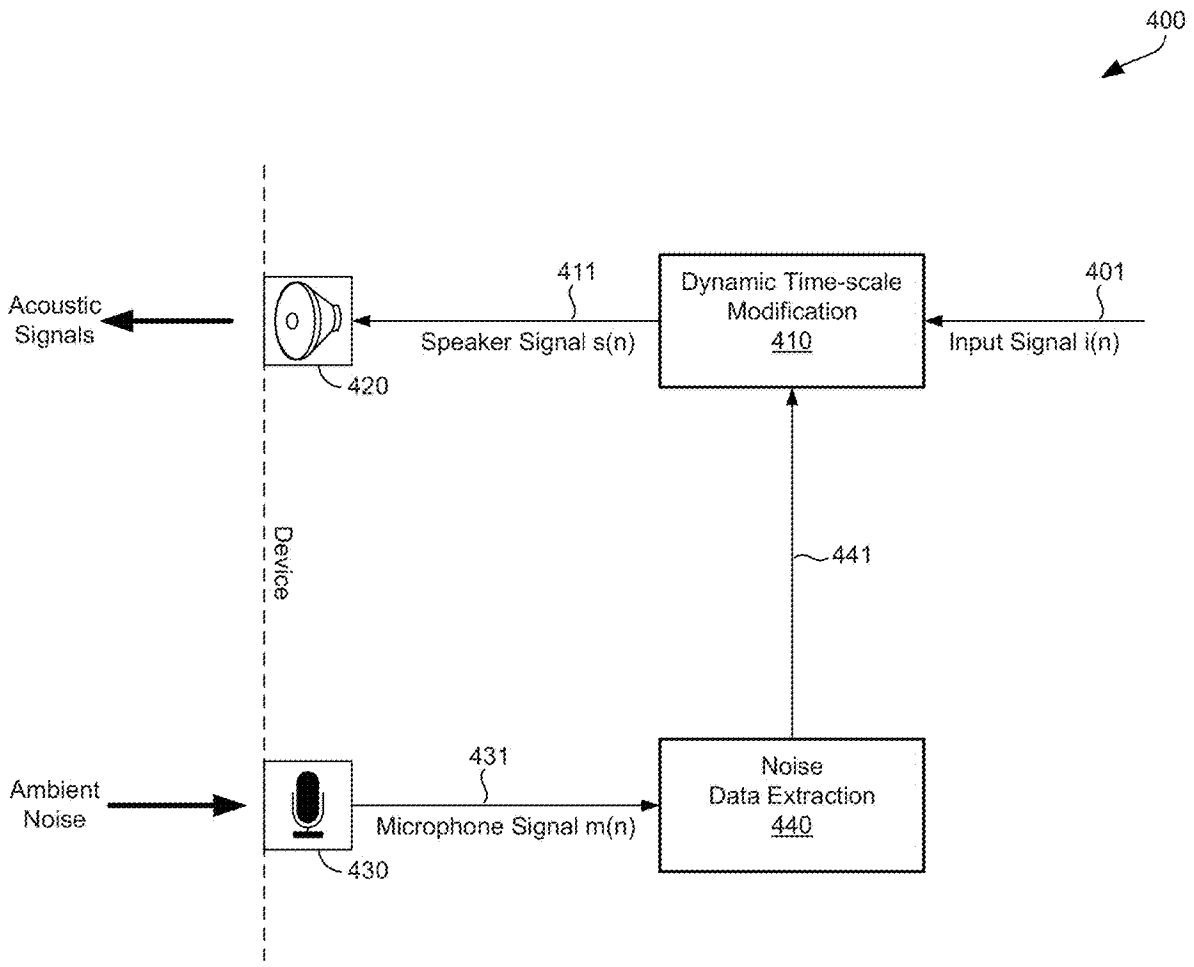
FIG. 4 illustrates an example system that may support near-end listening intelligibility enhancement based on dynamic time-scale modification.

FIG. 4 illustrates an example system that may support near-end listening intelligibility enhancement based on dynamic time-scale modification. Referring to FIG. 4, there is shown a system 400 for providing listening intelligibility enhancement based on dynamic time-scale modification.

The system 400 may comprise suitable circuitry for outputting audio, and for providing adaptive enhancement of listening intelligibility associated therewith, particularly based on dynamic time-scale modifications. The system 400 may correspond to the electronic device 200 (or portions thereof) when that device is utilized during outputting of acoustics signals comprising speech or other audio that may be experienced by listeners. As shown in the example implementation depicted in FIG. 4, the system 400 may comprise a dynamic time-scale modification block 410, a speaker 420, a microphone 430, and a noise data extraction block 440.

The dynamic time-scale modification block 410 may comprise suitable circuitry for generating output acoustic signals, based on input signals and for outputting via a speaker (e.g., the speaker 420), and for particularly configuring the generated output acoustic signals that optimize listening intelligibility by listeners. In particular, the dynamic time-scale modification block 410 may be configured to improve the listening intelligibility of speech signals outputted by system 400 based on dynamic time-scale modifications. In this regard, with dynamic time-scale modification, signals (speech) may be adaptively slowed down or stretched in real time, result in an accumulating delays, which may be compensated for by shortening natural pauses (e.g., in the speech). For purposed of enhancing listening intelligibility, the modifications may be controlled based on noise parameters, to ensure enhanced listening intelligibility over ambient noise, as described in more details below.

The noise data extraction block 440 may comprise suitable circuitry for processing signals corresponding to noise, such as to provide data that may be used for adaptive noise based control of audio output operations in the system 400. The noise data extraction block 440 may be configured to analyze, for example, captured microphone signals, corresponding to ambient noise, to enable obtaining or generating ambient noise related parameters.

In operation, the system 400 may be utilized to output audio, represented as input signal 401, i(n), and to particularly provide enhanced listening intelligibility. The input signal 401, i(n), may correspond to far-end audio (i.e. audio originating from a remote source, which is communicating the audio to a device incorporating the system 400), or may be near-end audio or speech—i.e. generated in the same device that incorporates the system 400. The listening intelligibility may be affected by ambient noise. Accordingly, to support the listening intelligibility enhancement, ambient noise may be detected by the microphone 430, with the corresponding microphone output 431, m(n), being applied to the noise data extraction block 440. The noise data extraction block 440 may be configured to detect the ambient noise data (e.g., signal parameters), and pass the ambient noise data to the dynamic time-scale modification block 410.

The dynamic time-scale modification block 410 may function to, for example, improve the intelligibility of the speech signal by taking into account the amount of ambient noise that is present and extracted by the noise data extraction block 440. In this regard, slowing down a signal or stretching the speech in real time may result in an accumulating delay. The accumulated delay, however, may be compensated for by shortening natural pauses in the speech. Thus, the dynamic time-scale modification block 410 may use the noise parameters extracted by the noise data extraction block 440 to control the time-scale adjustment—i.e. increase or decrease the percentage stretching of the speech (i.e., the input signal 401) based on the noise parameters. Slowing down the incoming speech (i.e., the input signal 401) in the presence of noise raises the intelligibility of that speech and therefore the degree of speech stretching is proportional to the amount of ambient noise. If there is little or no ambient noise, then the speaker signal 411 may be the same or very similar to the input signal 401. If, however, the ambient noise is significant, then the speaker signal 411 may be a stretched version of the input signal 401.

Thus, the noise level may determine the level of the slowdown. In this regard, the percentage of speech stretching may be dynamically increased and/or decreased as the ambient noise varies (based on constant, real-time input of noise data/parameters, from the noise data extraction block 440, as it continually processes the ambient noise represented in the microphone signal 431, being generated in real-time by the microphone 430). The level of the slowdown may be calculated by weighting the frequency components since some frequency components affect intelligibility more. For example, in a particular example use scenario, dynamic time-scale modification may comprise determining the pitch; artificially generating speech based on pitch measurement (e.g., based on real speech data, which may be stored in a buffer); and using overlap-add techniques to connect the artificial speech to the real speech by increasing the time.

Figure 5:
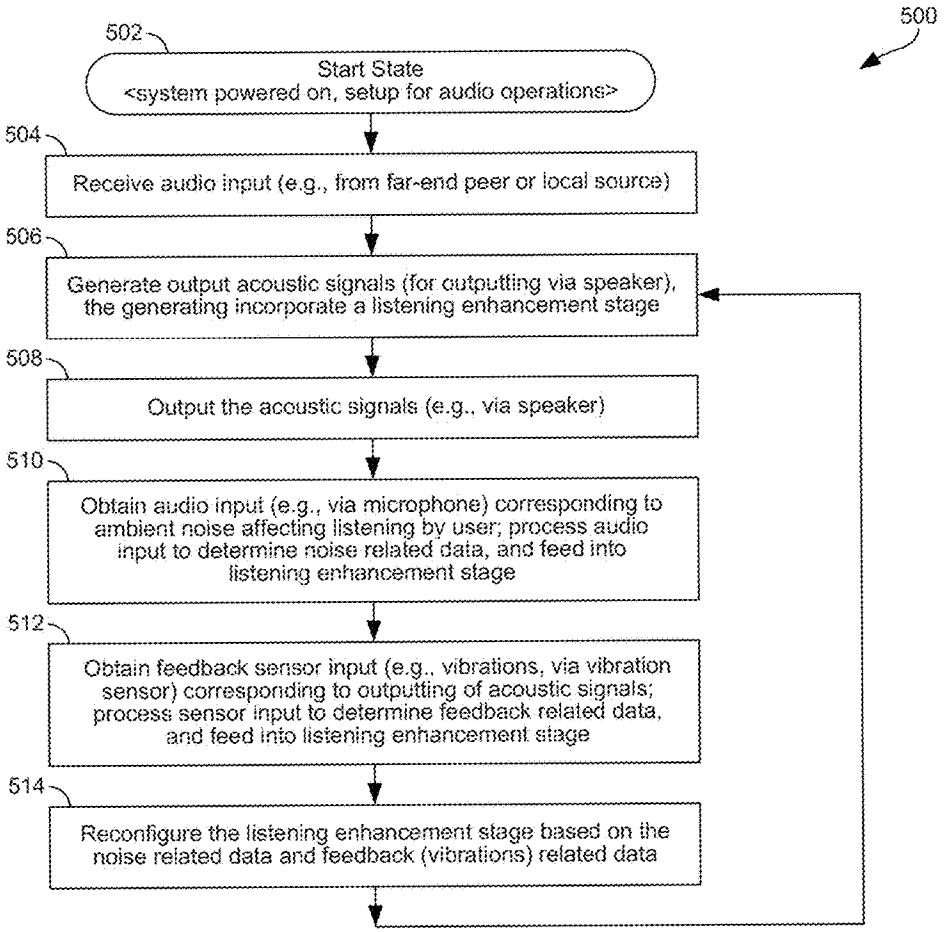
FIG. 5 is a flowchart illustrating an example processing for providing near-end listening intelligibility enhancement based on acoustic feedback.

FIG. 5 is a flowchart illustrating an example processing for providing near-end listening intelligibility enhancement based on acoustic feedback. Referring to FIG. 5, there is shown a flow chart 500, comprising a plurality of example steps, which may be executed in a system (e.g., the system 300 of FIG. 3) to provide near-end listening intelligibility enhancement based on acoustic feedback.

In starting step 502, the system may be powered on and/or setup for audio related operations (e.g., for reception of signals carrying audio content, extracting content, processing and/or outputting of audio, etc.)

In step 504, audio input may be received (e.g., from a far-end source and/or from a local source). In step 506, output acoustic signals (for outputting via speaker—e.g., the speaker 320) corresponding to the audio input may be generated. In this regard, generating the output acoustic signals may incorporate a listening enhancement stage, configured to enhance listening intelligibility as experienced by the user. In step 508, the acoustic signals may be outputted (e.g., via the speaker).

In step 510, audio input may be obtained (e.g., via a microphone, such as the microphone 330), corresponding to ambient noise affecting listening intelligibility experienced by the user. The audio input may then be processed (e.g., via the noise data extraction block 340), to determine noise related data, with the corresponding data being fed into the listening enhancement stage applied during generation of output acoustic signals.

In step 512, feedback sensor input (e.g., vibrations in case 350) may be obtained (e.g., via vibration sensor, such as the sensor 370), corresponding to the outputting of the acoustic signals. The sensor input may then be processed (e.g., via the sensor data extraction block 370), to determine sensor related data, with the corresponding data being fed into the listening enhancement stage applied during generation of output acoustic signals.

In step 514, the listening enhancement stage may then be reconfigured and/or adjusted based on the noise related data and feedback (vibrations) related data, and the process may loop back to continue processing of input audio and generation (and outputting) of output acoustic signals based thereon. While steps 510-514 are shown as 'following' the outputting of acoustic signals done in step 508, these steps may actually be done in parallel and/or independent of each other—i.e., obtaining the audio input (noise) or sensor input (vibration) may be continually done, as long as audio handling is ongoing, with corresponding data feeds (and reconfiguration of listening enhancement stage based thereon) being done dynamically and continually.

Figure 6:
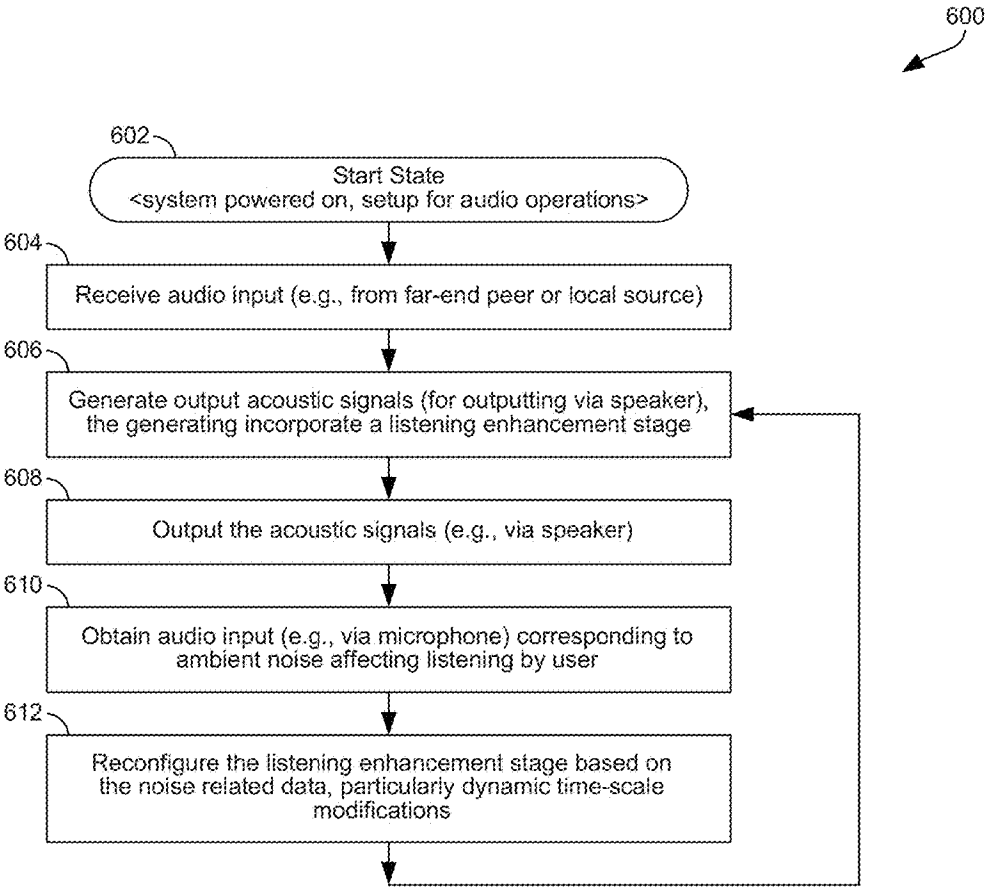
FIG. 6 is a flowchart illustrating an example processing for providing near-end listening intelligibility enhancement based on dynamic time-scale modification.

FIG. 6 is a flowchart illustrating an example processing for providing near-end listening intelligibility enhancement based on dynamic time-scale modification. Referring to FIG. 6, there is shown a flow chart 600, comprising a plurality of example steps, which may be executed in a system (e.g., the system 400 of FIG. 4) to provide near-end listening intelligibility enhancement based on dynamic time-scale modification.

In starting step 602, the system may be powered on and/or setup for audio related operations (e.g., for reception of signals carrying audio content, extracting content, processing and/or outputting of audio, etc.)

In step 604, audio input may be received (e.g., from far-end source and/or from local source). In step 606, output acoustic signals (for outputting via a speaker—e.g., the speaker 420) corresponding to the audio input may be generated. In this regard, generating the output acoustic signals may incorporate a listening enhancement stage, configured to enhance listening intelligibility as experienced by the user. In step 608, the acoustic signals may be outputted (e.g., via the speaker).

In step 610, audio input may be obtained (e.g., via microphone, such as the microphone 430), corresponding to ambient noise affecting listening intelligibility experienced by the user. The audio input may then be processed (e.g., via the noise data extraction block 440), to determine noise related data, with the corresponding data being fed into the listening enhancement stage applied during generation of output acoustic signals.

In step 612, the listening enhancement stage may then be reconfigured and/or adjusted based on the noise related data, with the reconfiguration particularly comprising dynamic time-scale modification (as described with respect to FIG. 4). The process may the loop back to continue processing of input audio and generation (and outputting) of output acoustic signals based thereon. Further, steps 610-612 are shown as 'following' the outputting of acoustic signals done in step 608, these steps may actually be done in parallel and/or independent of each other—i.e., obtaining the audio input (noise) or sensor input (vibration) may be continually done, as long as audio handling is ongoing, with corresponding data feeds (and reconfiguration of listening enhancement stage based thereon) being done dynamically and continually.

In some example implementations, a method for enhancing listening intelligibility of output audio may be used in an electronic device (e.g., the electronic device 200). The method may comprise outputting acoustic signals via a speaker (e.g., speaker 230); obtaining, via a microphone (e.g., the microphone 220), input audio corresponding to ambient noise in proximity of a user of the electronic device; processing (e.g., by the audio processor 210) the input audio to determine ambient noise data; and adaptively controlling the outputting of the acoustic signals, based on the determined ambient noise data, to enhance listening intelligibility. Sensor input (e.g., vibrations), corresponding to outputting of the acoustic signals by the electronic device, may be obtained, via a sensor in the electronic device (e.g., the VSensor 250). The sensor input may be processed to determine sensory based data. The sensory based data may comprise parameters related to one or more of indication of speech intelligibility, distortion level, distortion associated frequencies, and metric of difference between the outputted acoustic signals and the sensor input. The outputting of the acoustic signals may be adaptively controlled based on the determined sensory based data. In this regard, the outputting of the acoustic signals may be adaptively controlled based on determined sensory based data by using the sensory based data to estimate the acoustic signals experienced by the user. The adaptive controlling comprises applying dynamic time-scale modifications to the acoustic signals based on the determined ambient noise data.

In some example implementations, a system comprising one or more circuits in an electronic device (e.g., the audio processor 210 and/or other audio related circuitry of the electronic device 200) may be used in enhancing listening intelligibility of output audio of the electronic device. The one or more circuits may be operable to output acoustic signals via a speaker (e.g., speaker 230); obtain, via a microphone (e.g., the microphone 220), input audio corresponding to ambient noise in proximity of a user of the electronic device; process (e.g., by the audio processor 210) the input audio to determine ambient noise data; and adaptively control the outputting of the acoustic signals, based on the determined ambient noise data, to enhance listening intelligibility. The one or more circuits may be operable to obtain via a sensor in the electronic device (e.g., the VSensor 250), sensor input (e.g., vibrations) corresponding to outputting of the acoustic signals by the electronic device. The one or more circuits may be operable to process the sensor input, to determine sensory based data. The sensory based data may comprise parameters related to one or more of indication of speech intelligibility, distortion level, distortion associated frequencies, and metric of difference between the outputted acoustic signals and the sensor input. The one or more circuits may be operable to adaptively control the outputting of the acoustic signals based on the determined sensory based data. In this regard, one or more circuits may be operable to adaptively control the outputting of the acoustic signals based on the determined sensory based data by using the sensory base data to estimate the acoustic signals experienced by the user. The adaptive controlling comprises applying dynamic time-scale modifications to the acoustic signals based on the determined ambient noise data.

In some example implementations, a system (e.g., the system 300 or 400) may be used in enhancing listening intelligibility of output audio. The system may comprise a speaker (e.g., the speaker 320 or 420) that may be operable to output acoustic signals to a user; a microphone (e.g., the microphone 330 or 430) that may be operable to obtain an audio input corresponding to ambient noise in proximity of the user; a noise processing circuit (e.g., the noise data extraction block 340 or 440) that may be operable to process the audio input, to determine ambient noise data; and an output controller circuit (the listening enhancement block 310 or the dynamic time-scale modification block 410) that may be operable to adaptively control the outputting of the acoustic signals based on the determined ambient noise data. The system may further comprise a sensor (e.g., the sensor 360) that is operable to obtain sensor input corresponding to outputting of the acoustic signals by the electronic device. The system may further comprise a sensor processing circuit (e.g., the noise data extraction block 340) that is operable to process the sensor input to determine sensory based data. The sensory based data may comprise parameters related to one or more of indication of speech intelligibility, distortion level, distortion associated frequencies, and metric of difference between the outputted acoustic signals and the sensor input. The output controller circuit may be operable to adaptively control the outputting of the acoustic signals based on the determined sensory based data. In this regard, the output controller circuit may be operable to adaptively control the outputting of the acoustic signals based on the determined sensory based data by using the sensory base data to estimate the acoustic signals experienced by the user. The output controller circuit may be operable to apply dynamic time-scale modifications to the acoustic signals based on the determined ambient noise data.

Other implementations may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the steps as described herein for non-intrusive noise cancelation.

Accordingly, the present method and/or system may be realized in hardware, software, or a combination of hardware and software. The present method and/or system may be realized in a centralized fashion in at least one computer system, or in a distributed fashion where different elements are spread across several interconnected computer systems. Any kind of computer system or other system adapted for carrying out the methods described herein is suited. A typical combination of hardware and software may be a general-purpose computer system with a computer program that, when being loaded and executed, controls the computer system such that it carries out the methods described herein. Another typical implementation may comprise an application specific integrated circuit or chip.

The present method and/or system may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form. Accordingly, some implementations may comprise a non-transitory machine-readable (e.g., computer readable) medium (e.g., FLASH drive, optical disk, magnetic storage disk, or the like) having stored thereon one or more lines of code executable by a machine, thereby causing the machine to perform processes as described herein.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. Therefore, it is intended that the present method and/or system not be limited to the particular implementations disclosed, but that the present method and/or system will include all implementations falling within the scope of the appended claims.

What is claimed is:

1. A method, comprising:

outputting acoustic signals via a speaker of an electronic device;

obtaining, via a microphone, input audio corresponding to ambient noise in proximity of a user of the electronic device;

processing the input audio to determine ambient noise data;

adaptively controlling the outputting of the acoustic signals, based on the determined ambient noise data, to enhance listening intelligibility;

wherein the adaptively controlling of the outputting of the acoustic signals comprises applying dynamic time-scale modification to the acoustic signals; and wherein the applying of the dynamic time-scale modification comprises adjustments at least one of a speed and a duration of the acoustic signals without affecting a pitch of the acoustic signals.

2. The method of claim 1, comprising determining acoustic control data; wherein the acoustic control data comprise parameters related to an indication of speech intelligibility.

3. The method according to claim 1, comprising obtaining, via a vibration sensor of the electronic device, vibration sensor signals corresponding to outputting of the acoustic signals by the speaker of the electronic device; and wherein the adaptively controlling the outputting of the acoustic signals is based on the determined ambient noise data and the vibration sensor signals.

4. The method of claim 3, comprising determining acoustic control data; and adaptively controlling the outputting of the acoustic signals based on the determined acoustic control data by using the acoustic control data to estimate acoustic signals experienced by the user.

5. The method of claim 3, comprising determining acoustic control data; and detecting, based on the acoustic control data, distortion in one or more particular frequencies.

6. The method of claim 5, wherein the adaptive controlling comprises amplifying frequencies in the outputted acoustic signals other than the one or more particular frequencies.

7. The method of claim 5, comprising generating and/or adjusting, based on the detected distortion, one or more parameters for use in blocking expected distortion in the outputted acoustic signals.

8. The method according to claim 3 wherein the vibration sensor signals do not include or include only a negligible amount of signals that are part of the input audio.

9. The method according to claim 3 wherein the acoustic signals represent speech and wherein the applying of the dynamic time-scale modification comprises dynamically varying a degree of slowing down the speech in proportion to a detected ambient noise.

10. The method according to claim 3 comprises shortening a duration of non-speech parts of the acoustic signals.

11. The method of claim 3, comprising determining acoustic control data; wherein the acoustic control data comprise parameters related to a metric of difference between the outputted acoustic signals and the vibration sensor signals.

12. The method of claim 3, comprising determining acoustic control data; wherein the acoustic control data comprise parameters related to one or more of distortion level and distortion associated frequencies.

13. The method according to claim 1 wherein the applying of the dynamic time-scale modification comprises adjustments of the speed and the duration of the acoustic signals without affecting the pitch of the acoustic signals.

14. The method according to claim 1 wherein the applying of the dynamic time-scale modification comprises adjustments of the speed but not the duration of the acoustic signals without affecting the pitch of the acoustic signals.

15. The method according to claim 1 wherein the applying of the dynamic time-scale modification comprises adjustments of the duration but not the speed of the acoustic signals without affecting the pitch of the acoustic signals.

16. A system, comprising:

a speaker of an electronic device that is configured to output acoustic signals;

a microphone that is configured to obtain input audio corresponding to ambient noise in proximity of a user of the electronic device;

at least one processor that is configured to process the input audio to determine ambient noise data; and an output controller circuit that is configured to adaptively control the outputting of the acoustic signals based on the determined ambient noise data, to enhance listening intelligibility; wherein the adaptively control of the outputting of the acoustic signals comprises applying dynamic time-scale modification to the acoustic signals; and wherein the applying of the dynamic time-scale modification comprises adjustments at least one of a speed and a duration of the acoustic signals without affecting a pitch of the acoustic signals.

17. The system of claim 16, wherein the at least one processor is configured to determine acoustic control data; wherein the acoustic control data comprise parameters related to an indication of speech intelligibility.

18. The system according to claim 16, comprising a vibration sensor that is configured to obtain vibration sensor signals corresponding to outputting of the acoustic signals by the speaker of the electronic device; and wherein the output controller circuit is configured to adaptively control the outputting of the acoustic signals based on the determined ambient noise data and the vibration sensor signals.

19. The system of claim 18, wherein the at least one processor is configured to determine acoustic control data; wherein the output controller circuit operable to adaptively control the outputting of the acoustic signals based on the determined acoustic control data by using a sensory base data to estimate the acoustic signals experienced by the user.

20. The system of claim 18, wherein the at least one processor is configured to determine acoustic control data; wherein the at least one processor is operable to detect, based on the acoustic control data, distortion in one or more particular frequencies.

21. The system of claim 20, wherein the output controller circuit is configured to amplify frequencies in the outputted acoustic signals other than the one or more particular frequencies.

22. The system of claim 20, wherein the output controller circuit is operable to generate and/or adjust, based on the detected distortion, one or more parameters for use in blocking expected distortion in the outputted acoustic signals.

23. The system of claim 18, that is operable to determine acoustic control data based on the input audio obtained via the microphone and the vibration sensor signals.

24. The system according to claim 18 wherein the vibration sensor signals do not include or includes a negligible amount of signals that are part of the input audio.

25. The system according to claim 18 that is configured to apply the dynamic time-scale modification by dynamically varying a degree of slowing down the speech in proportion to a detected ambient noise.

26. The system according to claim 18 that is configured to apply the dynamic time-scale modification by shortening a duration of non-speech parts of the acoustic signals.

27. The system of claim 18, the at least one processor is configured to determine acoustic control data; wherein the acoustic control data comprise parameters related to a metric of difference between the outputted acoustic signals and the vibration sensor signals.

28. The system of claim 18, the at least one processor is configured to determine acoustic control data; wherein the acoustic control data comprise parameters related to one or more of distortion level and distortion associated frequencies.

29. The system according to claim 16 wherein the output controller circuit is configured to adjust the speed and the duration of the acoustic signals without affecting the pitch of the acoustic signals.

30. The system according to claim 16 wherein the output controller circuit is configured to adjust the speed but not the duration of the acoustic signals without affecting the pitch of the acoustic signals.

31. The system according to claim 16 wherein the output controller circuit is configured to adjust the duration but not the speed of the acoustic signals without affecting the pitch of the acoustic signals.

* * * * *